US011986722B2

(12) United States Patent
Gajardo Munoz

(10) Patent No.: US 11,986,722 B2
(45) Date of Patent: May 21, 2024

(54) HANDHELD POOL GAME CLOCK APPARATUS

(71) Applicant: Daniel Andres Gajardo Munoz, Geneva, IL (US)

(72) Inventor: Daniel Andres Gajardo Munoz, Geneva, IL (US)

( * ) Notice: Subject to any disclaimer, the term of this patent is extended or adjusted under 35 U.S.C. 154(b) by 295 days.

(21) Appl. No.: 17/402,412

(22) Filed: Aug. 13, 2021

(65) Prior Publication Data

US 2022/0047932 A1 Feb. 17, 2022

Related U.S. Application Data

(60) Provisional application No. 63/065,358, filed on Aug. 13, 2020.

(51) Int. Cl.
*A63B 71/06* (2006.01)

(52) U.S. Cl.
CPC .... *A63B 71/0686* (2013.01); *A63B 2243/002* (2013.01); *A63F 2250/1063* (2013.01)

(58) Field of Classification Search
CPC ..... A63B 71/0686; A63B 2243/002; G04B 37/12; G04F 3/08; A63D 15/20
See application file for complete search history.

(56) References Cited

U.S. PATENT DOCUMENTS

| | | | | |
|---|---|---|---|---|
| 8,992,315 | B2 | 3/2015 | Lundback et al. | |
| 2008/0182675 | A1* | 7/2008 | Flores | A63D 15/20 473/4 |
| 2009/0289103 | A1* | 11/2009 | Daicos | A63B 71/0669 235/1 B |
| 2012/0256373 | A1* | 10/2012 | Tam | A63D 15/20 273/148 R |
| 2016/0253651 | A1* | 9/2016 | Park | G06Q 20/34 705/39 |
| 2018/0264345 | A1* | 9/2018 | Kim | A63B 71/0669 |

OTHER PUBLICATIONS

TVCMall, Chess Clock Timer Clock Game Timer Chess Digital Timer Board Game Clock, tvc-mall.com, Jul. 2021.
Memphisto, Chess Game Clock II Digital Game Timer, ebay.com, Jan. 2012.
FlipTimer, Digital Game Timer, ebay.com, Jun. 2021.

* cited by examiner

*Primary Examiner* — Andrew Schechter
*Assistant Examiner* — Jeremy A Delozier

(57) ABSTRACT

A handheld pool game clock apparatus suited for timekeeping pool/billiard games is presented. The handheld pool game clock apparatus contains a clock body, at least one display, a processing unit, at least one switch, and a control panel. The at least one display is distributed around the clock body. The processing unit and the at least one switch are connected within the clock body. The control panel is connected adjacent to the clock body. The at least one display, the control panel, and the at least one switch are electronically connected to the processing unit.

11 Claims, 6 Drawing Sheets

HANDHELD POOL GAME CLOCK APPARATUS

The current application claims a priority to the U.S. Provisional Patent application Ser. No. 63/065,358 filed on Aug. 13, 2020.

FIELD OF THE INVENTION

The present invention relates generally to time keeping devices, specifically time keeping devices for pool or billiard games.

BACKGROUND OF THE INVENTION

Slow play is one of the main problems in pool tournaments and leagues. Although a lot of leagues and tournaments have an official time limit to address the shots, it is extremely rare that this rule is enforced and respected, because a time keeper/referee would need to be present at every table, which is very burdensome and expensive, and therefore never happens. Previous means of timing players rely on hand timers being used by referees or on big wall timer devices used in one-table arenas. This invention is designed to be carried and placed on each pool table. Timekeepers/referees have to be paid. In a tournament with dozens or even hundreds of tables, that can be very expensive and requires an extensive logistic. And wall timer devices only work on a one-table arena. Timekeepers or referees can also be a disruption during play, especially among amateur players. Wall timer devices are expensive and can be disruptive if more than one table is at play. Therefore, it is an objective of the present invention to provide a non-disruptive means of time keeping and pacing pool gameplay.

The present invention is an auto-timing clock that can be monitored by both the player at the table and the opponent. The present invention prevents the player from feeling rushed. The present invention is both discreet and portable. Each player can time him or herself during play, with the supervision of their opponent(s). The present invention makes the game of pool more enjoyable for the players, the spectators, the tournament organizers, promoters, or anyone else associated with the game. The present invention allows for the games to run smoothly and for the tournaments to not being held back by lengthy matches. The "No Rush Clock" feature is also an "Auto-timing Clock" feature. More specifically, each player times him or herself during play, while being monitored by the opponent. This purpose is not to penalize a player for his or her slow play, but rather to apply a decent pace to each match.

SUMMARY OF THE INVENTION

The present invention is a handheld pool game clock apparatus suited for timekeeping pool/billiard games. The handheld pool game clock apparatus comprises a clock body, at least one display, a processing unit, at least one switch, and a control panel. The at least one display is distributed around the clock body. The processing unit and the at least one switch are connected within the clock body. The control panel is connected adjacent to the clock body. The at least one display, the control panel, and the at least one switch are electronically connected to the processing unit.

DETAIL DESCRIPTIONS OF THE INVENTION

Figure 1:
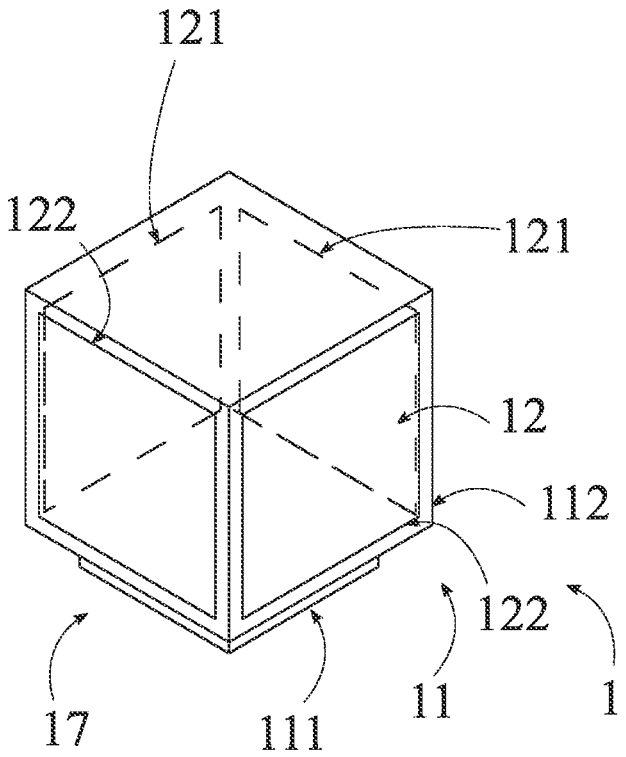
FIG. 1 is a top perspective view of the present invention showing a handheld pool game clock apparatus is configured to a base portion down position.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a handheld pool game clock apparatus 1. In reference to FIGS. 1-6, the handheld pool game clock apparatus 1 comprises a clock body 11, at least one display 12, a processing unit 13, at least one switch 14, and a control panel 17. The at least one display 12 is distributed around the clock body 11. The processing unit 13 and the at least one switch 14 are connected within the clock body 11. The control panel 17 is connected adjacent to the clock body 11. The at least one display 12, the control panel 17, and the at least one switch 14 are electronically connected to the processing unit 13. In the preferred embodiment of the present invention, the at least one switch 14 is a momentary switch. In the preferred embodiment of the present invention, the at least one switch 14 is at least one toggle switch. In the preferred embodiment of the present invention, the handheld pool game clock apparatus 1 is made out of a robust and suitable material, such as, but not limited to aluminum, plastic, wood, or any other suitable material. In the preferred embodiment of the present invention, the handheld pool game clock apparatus 1 is rectilinear in shape but may take the form of any other suitable shape.

Figure 2:
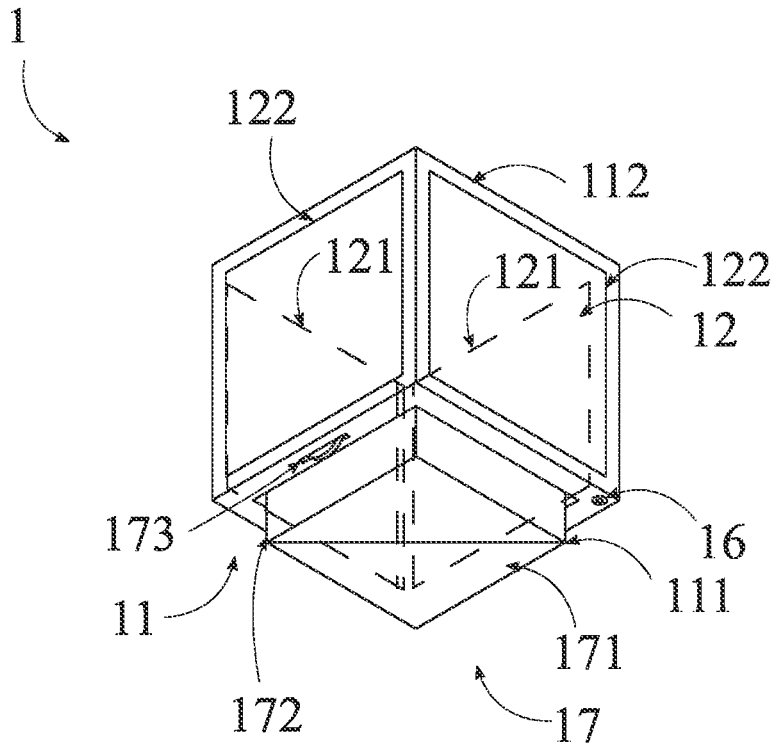
FIG. 2 is a bottom perspective view of the present invention showing a handheld pool game clock is configured to a base portion down position.
Figure 3:
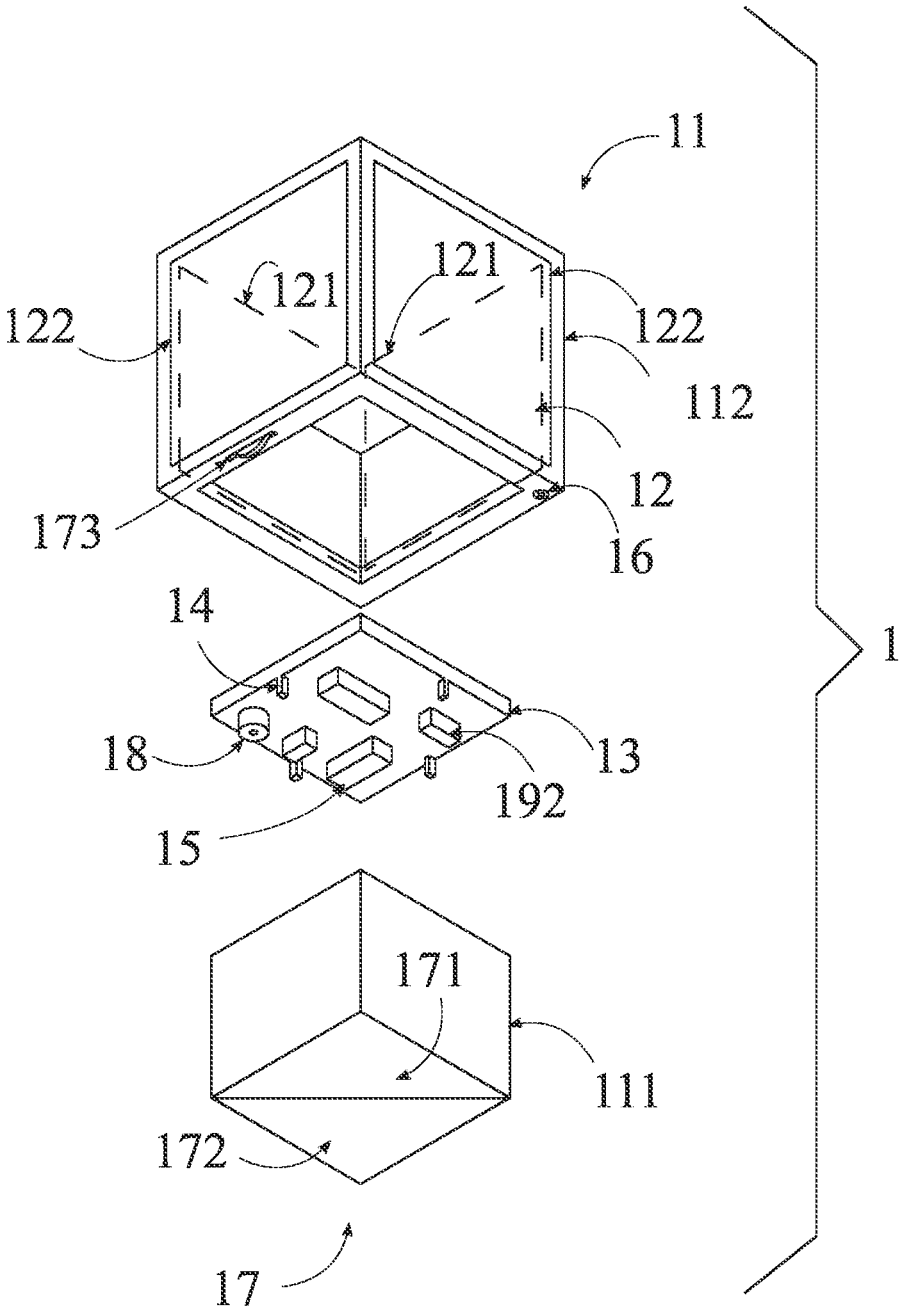
FIG. 3 is an exploded bottom perspective view of the present invention.
Figure 4:
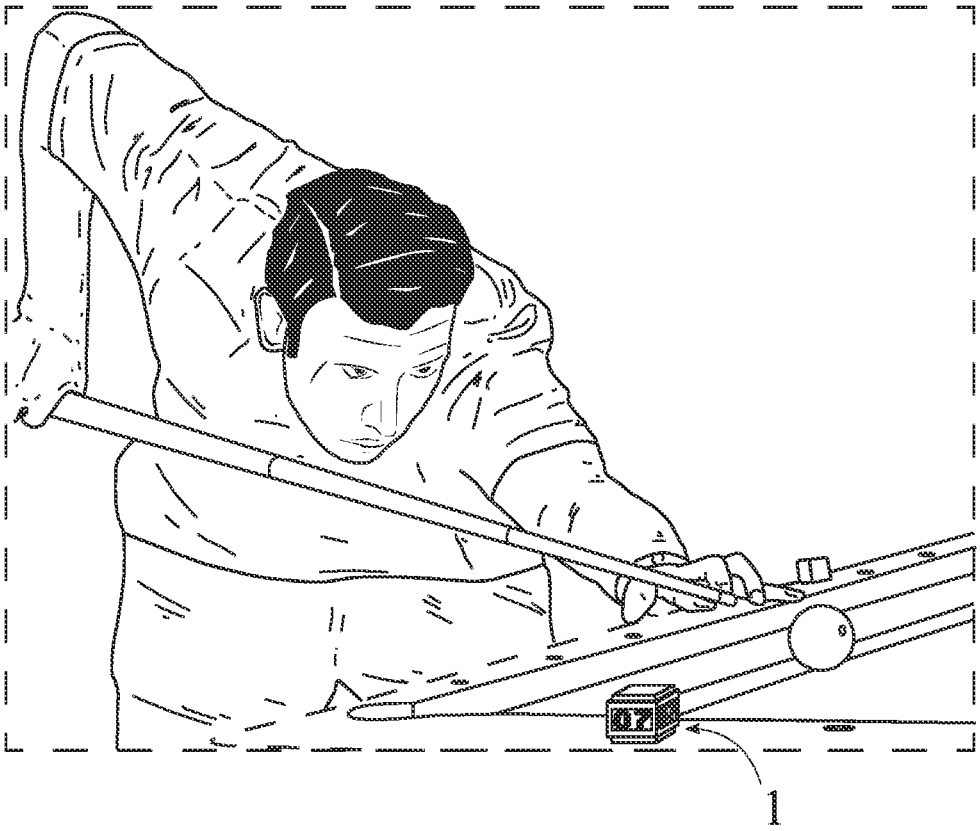
FIG. 4 is an illustration of the present invention that shows the handheld pool game clock apparatus being used by a first player.
Figure 5:
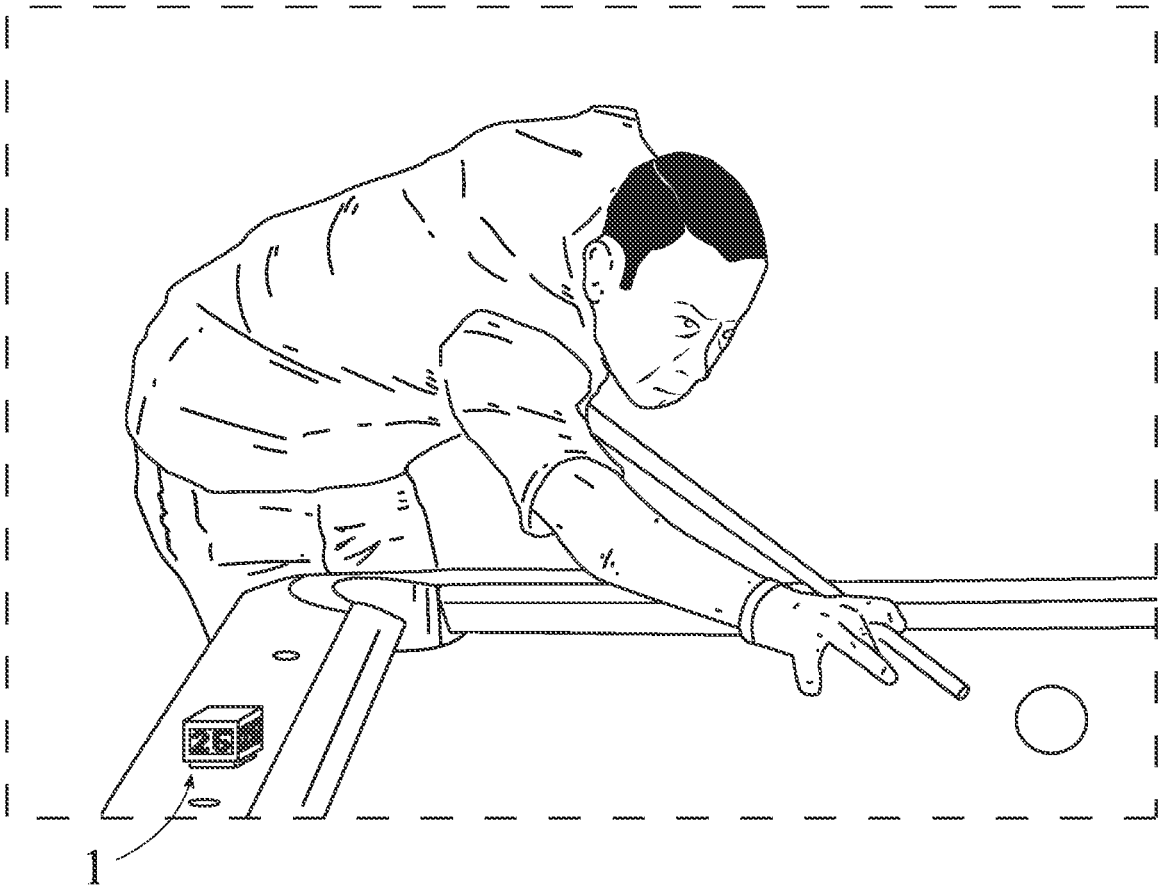
FIG. 5 is an illustration of the present invention that shows the handheld pool game clock apparatus being used by a second player.
Figure 6:
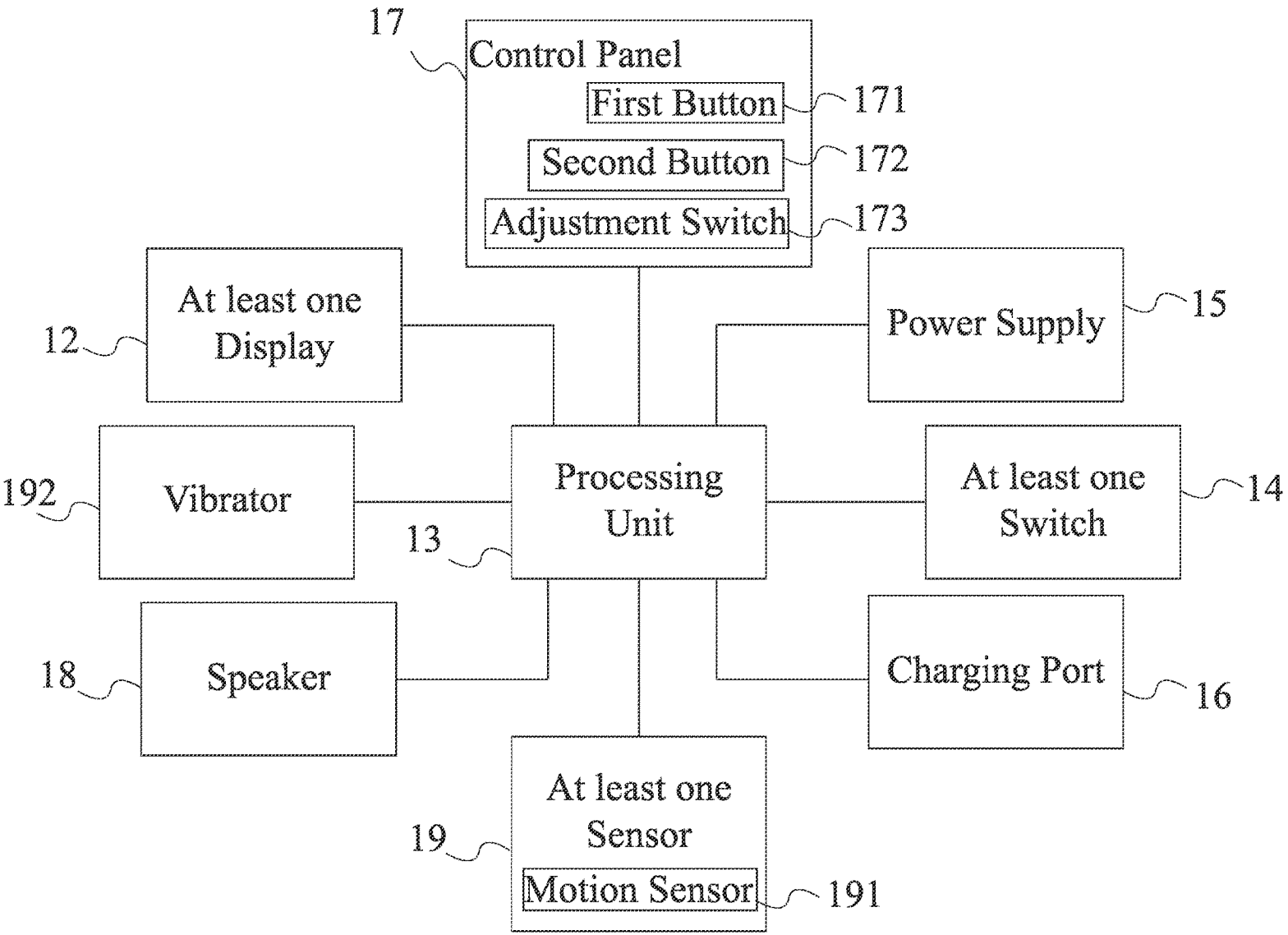
FIG. 6 is a diagram of electronic components used in the present invention.

The handheld pool game clock apparatus 1 further comprises a speaker 18, as shown in FIGS. 3 and 6. The speaker 18 is connected within to the clock body 11. The speaker 18 is electronically connected to the processing unit 13. The handheld pool game clock apparatus 1 further comprises at least one sensor 19, as shown in FIGS. 3 and 6. The at least one sensor 19 is distributed within the clock body 11. The at least one sensor 19 is electronically connected to the processing unit 13. In another embodiment, the clock body 11 comprises a base portion 111 and a housing portion 112 as shown in FIGS. 1-3. The base portion 111 is slidably connected to the housing portion 112. The at least one switch 14 is operatively engaged with the base portion 111 and the housing portion 112, where the at least one switch 14 is configured to actuate upon sliding the housing portion 112 along the base portion 111.

The at least one sensor 19 comprises a motion sensor 191, as shown in FIGS. 3 and 6. The motion sensor 191 is electronically connected to the processing unit 13. In the preferred embodiment of the present invention, the motion sensor 191 is an accelerometer. In the preferred embodiment of the present invention, the motion sensor 191 is a geomagnetic sensor. The accelerometer and the geomagnetic field sensor are operatively engaged with the processing unit 13, where the accelerometer and the geomagnetic field sensor are configured to determine if the pool game clock is in an upright position or in an upside-down position. In the upside-down position, the handheld pool game clock apparatus 1 displays the score of the match. The accelerometer and the geomagnetic field sensor are also operatively engaged with the processing unit 13, such that it recognizes a pause configuration. The pause configuration is enabled when there's is a time-out in the game, a disruptive occurrence (such as a player on the next table preventing you from taking a shot, someone asking a question about rules, one of the players wanting to check the score, etc.), or when players are in between games and that points need to be added to the score.

The at least one display 12 comprises a first display set 121 and a second display set 122, as shown in FIGS. 1-3. The first display set 121 and the second display set 122 are electronically connected to the processing unit 13. The first display set 121 and the second display set 122 are interspersed with each other around the clock body 11. In the preferred embodiment of the present invention, the at least one display 12 and the at least one switch 14 is configured in to two halves, where each half represents one of two players. The first display set 121 shows the first players score, and the second display set 122 shows the second players score. In the preferred embodiment of the present invention, the first display set 121 and the second display set 122 are configured to each display the score for one of two players. Preferably, the first display set 121 and the second display set 122 are alternatingly distributed about the body so that each player may see their score at most viewing angles. In some embodiments, the first display set 121 and the second display set 122 each comprise two displays positioned opposite each other along the body, resulting in a total of four displays in a rectilinear embodiment. In embodiments with other geometries, such as, but not limited to, hexagonal, the first display set 121 and the second display set 122 may correspondingly comprise different numbers and/or arrangement of displays.

The control panel 17 comprises a first button 171 and a second button 172, as shown in FIGS. 1 and 6. The first button 171 and the second button 172 are positioned adjacent to the clock body 11. The first button 171 and the second button 172 are electronically connected to the processing unit 13. In the preferred embodiment of the present invention, the first button 171 and the second button 172 are operatively engaged with the processing unit 13, such that the first button 171 adjusts the score of the first display and the second button 172 adjusts the score of the second display. In the preferred embodiment of the present invention, actuating both the first button 171 and the second button 172 may reset the first display set 121 and the second display set 122 score visuals.

The control panel 17 further comprises an adjustment switch 173, as shown in FIGS. 1 and 6. The adjustment switch 173 traverses into the case body to the processing unit 13. The adjustment switch 173 is electronically connected to the processing unit 13. In the preferred embodiment of the present invention, the adjustment switch 173 is configured to adjust the volume of the speaker 18 and the brightness of the at least one display 12. In the preferred embodiment of the present invention, the adjustment switch 173 is configured to adjust the time limit setting of the handheld pool game clock apparatus 1. The handheld pool game clock apparatus 1 further comprises a power supply 15 and a charging port 16, as shown in FIGS. 1 and 6. The power supply 15 is positioned within the clock body 11. The charging port 16 traverses into the clock body 11 to the processing unit 13. The power supply 15 and the charging port 16 is electronically connected to the processing unit 13. In the preferred embodiment of the present invention, the adjustment switch 173 may take the form of an adjustment wheel, but may take the form of any other suitable adjustment implement, such as, but not limited to buttons, dials, knobs, sliders, or any other suitable adjustment implement. In the preferred embodiment of the present invention, the power supply 15 may take the form of batteries that are easily replaceable from the processing unit 13. Alternatively, the power supply 15 may take the form of integrated rechargeable batteries where the user can charge the power supply 15 via AC adapter plugged in the charging port 16.

In the preferred embodiment of the present invention, the player who is at the table can place the handheld pool game clock apparatus 1 anywhere on the top of the playing table's frame, where he or she feels that it will be less disruptive for him or her. The handheld pool game clock apparatus 1 is visible to the opponent and spectators, anywhere between 6 and 20 feet away, because the at least one display 12 is digitally displaying the time in a 360-degree style view. The handheld pool game clock apparatus 1 allows the player at the table to start the time as soon as he or she comes to the table or when all the balls have come to a rest (or before if he/she wishes to) through the actuation of the at least one switch 14.

Depending on the setting or the color of the handheld pool game clock apparatus 1, the starting time will be set to a specified time interval that dictates the time allowed for each shot. Upon actuating the control panel 17, an audible noise produced by the speaker 18 is played once and the time starts counting down in a specified color, displayed along the at least one display 12. A specified time extension may be allowed once per game and at the beginning of each game, by actuating the at least one switch 14. This will allow the same number of seconds as the starting time to be added to the current time. A specified beep sound is played once. The last specified seconds are displayed in a specified color, followed by digressive audible sounds that accompany the last specified second.

When the zero second is reached, an extended beep sound is played and a still specified color and display appearance is displayed along the at least one display 12. This indicates that the player must address his shot as soon as he or she is ready. No penalty is given for addressing the shot after time limit is reached, as long as the player does not stand up. The only case in which a penalty would be imposed on the player (foul, ball in hand, etc.) is if the player stands up before addressing the shot and the handheld pool game clock apparatus 1 shows zero second is reached. The next shot or the next player is up where the player simply actuates the control panel 17 when arriving at the table or when all balls are no long in motion. Whether or not the zero second has been reached is immaterial at this time. Actuating the control panel 17 for a specified time may turn the handheld pool game clock apparatus 1 off or on. In the preferred embodiment of the present invention, the handheld pool game clock apparatus 1 further comprises a vibrator 192. The vibrator 192 is connected within the clock body 11. The vibrator 192 is electronically connected to the processing unit 13. In the preferred embodiment of the present invention, the vibrator 192 emits a pulsed vibration when a command is actuated. In one instance, a vibration may be felt when the device is turned off or on.

Although the invention has been explained in relation to its preferred embodiment, it is to be understood that many other possible modifications and variations can be made without departing from the spirit and scope of the invention as hereinafter claimed.

What is claimed is:

1. A handheld pool game clock apparatus comprising:
a clock body;
a plurality of displays;
a processing unit;
at least one switch;
a control panel;
a power supply;
at least one sensor;
the at least one sensor comprising a motion sensor;
the clock body comprising a base portion and a housing portion;
the plurality of displays being distributed around the clock body;
the processing unit, the at least one switch, and the at least one sensor being connected within the clock body;
the control panel being integrated into the base portion;
the plurality of displays, the control panel, the at least one switch, and the at least one sensor being electronically connected to the processing unit;
the power supply being positioned within the clock body;
the power supply being electronically connected to the processing unit;
the base portion being telescopically connected into the housing portion;
the at least one switch being operatively engaged with the base portion and the housing portion through the control panel, wherein the at least one switch is configured to actuate upon pressing the control panel and sliding the base portion into the housing portion;
the clock body being shaped as a geometric prism;
the clock body being sized to be a handheld object;
each of the plurality of displays being positioned onto a corresponding lateral face of the geometric prism;
the processor unit being configured to initiate and manage at least one countdown timer upon actuating the at least one switch;
the plurality of displays being configured to visually output the at least one countdown timer upon actuating the at least one switch; and
the processor unit being configured to pause/restart the at least one countdown timer upon detecting a specific movement of the clock body with the motion sensor.

2. The handheld pool game clock apparatus as claimed in claim 1 comprising:
a speaker;
the speaker being connected within the clock body;
the speaker being electronically connected to the processing unit;
the speaker being configured to audibly output a start notification for the at least one countdown timer; and
the speaker being configured to audibly output an end notification for the at least one countdown timer.

3. The handheld pool game clock apparatus as claimed in claim 1 comprising:
the plurality of displays comprising a first display set and a second display set;
the first display set and the second display set being electronically connected to the processing unit;
the first display set and the second display set being interspersed with each other around the clock body;
the processor unit being configured to manage a first score for a first player and a second score for a second player;
the first display set being configured to visually output the first score; and
the second display set being configured to visually output the second score.

4. The handheld pool game clock apparatus as claimed in claim 1 comprising:
the control panel comprising a first button and a second button;
the first button and the second button being positioned adjacent to the clock body;
the first button and the second button being electronically connected to the processing unit;
the processor unit being configured to manage a first score for a first player and a second score for a second player;
the processor unit being configured to adjust the first score upon actuating the first button; and
the processor unit being configured to adjust the second score upon actuating the second button.

5. The handheld pool game clock apparatus as claimed in claim 1 comprising:
the control panel comprising at least one adjustment switch;
the at least one adjustment switch traversing into the case body to the processing unit;
the at least one adjustment switch being electronically connected to the processing unit; and
the processor unit being configured to shorten/lengthen the at least one countdown timer upon actuating the at least one adjustment switch.

6. The handheld pool game clock apparatus as claimed in claim 1 comprising:
a charging port;
the charging port traversing into the clock body to the processing unit; and
the charging port being electronically connected to the processing unit.

7. The handheld pool game clock apparatus as claimed in claim 1 comprising:
a vibrator;
the vibrator being connected within the clock body; and
the vibrator being electronically connected to the processing unit.

8. The handheld pool game clock apparatus as claimed in claim 1, wherein the at least one switch is a momentary switch.

9. The handheld pool game clock apparatus as claimed in claim 1, wherein the at least one switch is at least one toggle switch.

10. The handheld pool game clock apparatus as claimed in claim 1, wherein the motion sensor is an accelerometer.

11. The handheld pool game clock apparatus as claimed in claim 1, wherein the motion sensor is a geomagnetic sensor.

* * * * *